US006821362B2

(12) United States Patent
Satou

(10) Patent No.: US 6,821,362 B2
(45) Date of Patent: Nov. 23, 2004

(54) MANUFACTURING METHOD OF AUGER

(75) Inventor: Akihiro Satou, Tokai (JP)

(73) Assignee: Hoshizaki Denki Kabushiki Kaisha, Toyoake (JP)

( * ) Notice: Subject to any disclaimer, the term of this patent is extended or adjusted under 35 U.S.C. 154(b) by 0 days.

(21) Appl. No.: 10/163,641

(22) Filed: Jun. 7, 2002

(65) Prior Publication Data

US 2003/0226622 A1 Dec. 11, 2003

(51) Int. Cl.[7] ..... C21D 9/22
(52) U.S. Cl. ..... 148/524; 148/525; 219/76.16
(58) Field of Search ..... 148/524, 525, 148/530; 219/76.16, 121.45

(56) References Cited

U.S. PATENT DOCUMENTS 4,472,619 A * 9/1984 Ueda et al. ..... 219/76.16
6,084,196 A * 7/2000 Flowers et al. ..... 319/121.46
6,403,235 B1 * 6/2002 Glidden et al. ..... 148/530
6,475,647 B1 * 11/2002 Mendez Acevedo et al. .... 219/76.16

FOREIGN PATENT DOCUMENTS

JP 2001-153509 A * 6/2001

OTHER PUBLICATIONS

Advanced Materials and Processes. vol. 156. No. 6, Dec. 1999, p. 52.*

* cited by examiner

*Primary Examiner*—George Wyszomierski
(74) *Attorney, Agent, or Firm*—Nixon & Vanderhye P.C.

(57) ABSTRACT

An auger composed of an auger body integrally formed with a spiral blade and at its opposite ends with a pair of shaft portions is manufactured by the steps of forming annular recesses on the shaft portions in a cutting process, building up an anti-abrasive and anti-corrosive alloy by plasma-arc welding in the annular recesses of the shaft portions and finishing each built-up portion of the alloy in a grinding process to form a journal portion on the respective shaft portions of the auger, wherein precipitation hardening stainless steel used as a base metal of the auger body is preheated for a predetermined time prior to the steps of plasma-arc welding of the alloy. In this manner, the stainless steel body is subjected to an aging heat treatment caused by (a) the preheating and (b) the subsequent welding heat generated during the plasma-arc welding process.

6 Claims, 1 Drawing Sheet

MANUFACTURING METHOD OF AUGER

BACKGROUND OF THE INVENTION

1. Field of the Invention

The present invention relates to a manufacturing method for an auger adapted for use in an auger type ice making machine, various kinds of extruding machines or the like.

2. Description of the Prior Art

An auger of this kind has an auger body integrally formed thereon with a spiral blade and formed at its opposite ends with a pair of shaft portions. In the auger, it is required to enhance anti-corrosiveness and strength of the auger body, and it is also required to enhance anti-abrasiveness and hardness of the shaft portions.

To satisfy the requirements, ferritic stainless steel, martensitic stainless steel, austenitic stainless steel or the like has been used as a base metal of the auger, and an anti-abrasive and anti-corrosive alloy containing, as main components, Co, Cr, Mo and Ni mixed at a predetermined ratio has been built up by plasma-arc welding in each annular recess formed on the shaft portions and finished by grinding to form a journal portion on the respective shaft portions.

To further enhance the strength and hardness of the auger, it is desirable that precipitation hardening stainless steel is used as a base metal of the auger. In use of the precipitation hardening stainless steel, it is, however, indispensable that the base metal is subjected to aging heat treatment to enhance the strength and hardness of the auger. This results in an increase of the manufacturing cost of the auger.

SUMMARY OF THE INVENTION

It is, therefore, a primary object of the present invention to provide a manufacturing method for an auger in which precipitation hardening stainless steel is used as a base metal of the auger without being subjected to traditional aging heat treatment but instead, being subjected to an aging heat treatment caused, in part, by pre-heating before applying welding heat during a plasma-arc welding process to enhance the strength and hardness of the auger at a low cost.

According to the present invention, this object is attained by providing a manufacturing method for an auger composed of an auger body integrally formed thereon with a spiral blade and at its opposite ends with a pair of shaft portions, comprising the steps of forming annular recesses on the shaft portions in a cutting process respectively, building up an anti-abrasive and anti-corrosive alloy by plasma-arc welding in the annular recesses of the shaft portions and finishing each built-up portion of the alloy in a grinding process to form a journal portion on the respective shaft portions of the auger, wherein precipitation hardening stainless steel used as a base metal of the auger body (without having been yet subjected to aging heat treatment for precipitation hardening) and is preheated for a predetermined time prior to the plasma-arc welding of the alloy and thereby subjected to an effective aging heat treatment caused by the combined effects of preheating and welding heat during the plasma-arc welding process.

In a practical embodiment of the present invention, it is preferable that the precipitation hardening stainless steel used as the base metal essentially consists of 17Cr, 4Ni and 4Cu or 17Cr, 7Ni and 1Al. In the plasma-arc welding process, it is desirable that the precipitation hardening stainless steel is preheated at a temperature of 300° C.–350° C. for twenty minutes-eighty minutes.

DESCRIPTION OF THE PREFERRED EMBODIMENT

Figure 1:
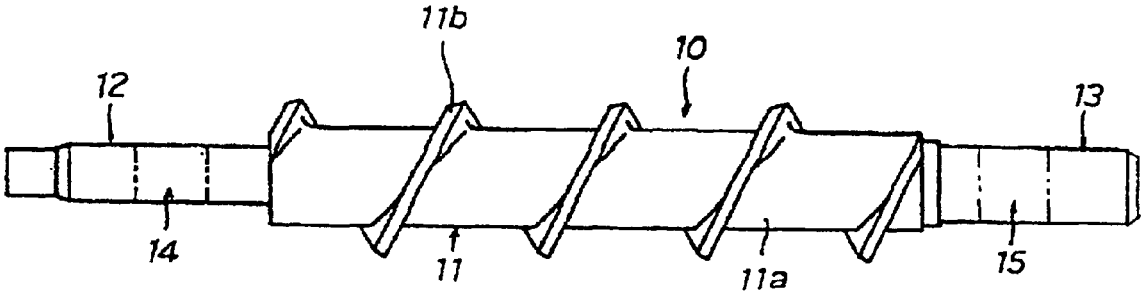
FIG. 1 is a side view of an auger produced by a manufacturing method of the present invention.

Illustrated in FIG. 1 of the drawings is an auger 10 adapted for use in an auger type ice making machine. The auger 10 is composed of an auger body 11 formed thereon with a spiral blade 11*b* and a pair of shaft portions 12 and 13 integrally formed with the auger body 11 at its opposite ends. The shaft portions 12 and 13 are formed with anti-abrasive and anti-corrosive journal portions 14 and 15 respectively at their central portions in an axial direction. The auger 10 is mounted at its shaft portions 12 and 13 for rotary movement in a cooling cylinder (not shown) forming a cooling chamber of the ice making machine and is drivingly connected to an output shaft of an electric motor (not shown).

In the auger, precipitation, hardening stainless steel subjected to solid-solution heat treatment was used as a base metal of the auger body 11 and shaft portions 12 and 13. In the manufacturing method according to the present invention, precipitation hardening stainless steel essentially consisting of 17 Cr, 4Ni and 4Cu was subjected to solid-solution heat treatment and used as the base metal without being subjected to traditional treatment for precipitation hardening. Similarly, precipitation hardening stainless steel essentially consisting of 17Cr, 7Ni and 1Al was subjected to solid-solution heat treatment and used as the base metal without being subjected to traditional aging heat treatment for precipitation hardening. Each surface layer of the journal portions 14 and 15 was formed by an anti-abrasive and anti-corrosive alloy built up by plasma-transfer-arc welding. The anti-abrasive and anti-corrosive alloy was prepared to contain, as main components, Co, Cr, Mo and Ni mixed at a predetermined ratio.

Figure 2:
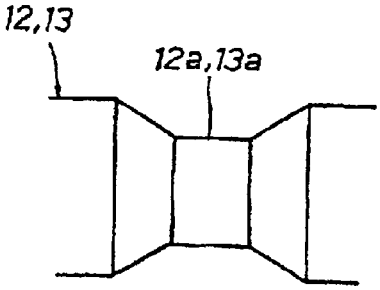
FIG. 2 is an enlarged side view of each shaft portion of the auger shown in FIG. 1.
Figure 3:
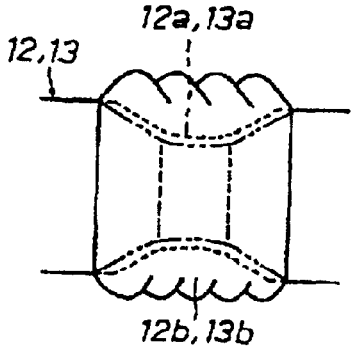
FIG. 3 is an enlarged side view of an anti-abrasive and anti-corrosive alloy built up on the shaft portion for forming a journal portion of the auger.

FIG. 2 illustrates each shaft portion 12, 13 of auger 10 to be formed thereon with the journal portions 14 and 15, and FIG. 3 illustrates the anti-abrasive and anti-corrosive alloy built up by plasma-arc welding on the shaft portions 12 and 13 respectively. The shaft portions 12 and 13 were preliminarily formed with annular recesses 12*a* and 13*a*, and the anti-abrasive and anti-corrosive alloy was built up by plasma-transfer-arc welding in the annular recesses 12*a*, 13*a* of shaft portions 12, 13. Thereafter, each built-up portion 12*b*, 13*b* of the alloy was finished by grinding to form the journal portions 14, 15 of auger 10, and the spiral blade 11*b* was formed on the outer periphery of auger body 11*a* in a cutting process.

In the plasma-transfer-arc welding process, the base metal was preheated at a temperature of 300° C.–350° C. for twenty to eighty minutes to avoid rapid heating at the annular recesses 12*a*, 13*a* of shaft portions 12, 13 and to avoid rapid cooling of the built-up portions 12*b*, 13*b* of the alloy. In such a preheated condition, the alloy was built up by plasma-transfer welding in the annular recesses 12*a*, 13*a* of shaft portions 12, 13. During the plasma-transfer-arc welding, the base metal was effectively subjected to aging heat treatment caused by the combined effects of the preheating and the welding heat. In such a manufacturing method of the auger as described above, the successively applied preheating and welding heat are effectively utilized in combination to effect aging heat treatment of the base metal. Thus, the auger 10 can be made of the stainless steel hardened by precipitation without being subjected to aging heat treatment in a conventional manner for precipitation hardening and can be manufactured at a low cost in comparison with a conventional auger made of precipitation hardening stainless steel manufactured by a conventional method.

Although in the manufacture of the auger, the precipitation hardening stainless steel was used as the base metal of the auger body 11 and shaft portions 12, 13 without being subjected to aging heat treatment for precipitation hardening, the stainless steel may be used as the base metal of the auger body or the base metal of the shaft portions in accordance with the purpose of use.

EXAMPLE

In a manufacturing process of the auger 10, precipitation hardening stainless steel (SUS 630) essentially consisting of 17 Cr, 4Ni and 4Cu was subjected to solid-solution heat treatment and used as the base metal of the auger body 11 and shaft portions 12, 13 without being subjected to aging heat treatment. This manufacturing process was carried out by the steps of connecting under pressure each base metal of the shaft portions 12 and 13 to opposite ends of the base metal of the auger body 11 in a friction welding process, forming the annular recesses 12*a*, 13*a* on each base metal of the shaft portions 12, 13 in a cutting process, building up the anti-abrasive and anti-corrosive alloy by plasma-transfer-arc welding in the annular recesses 12*a*, 13*a* of the shaft portions 12, 13, grinding each built up portion 12*b*, 13*b* of the alloy to form the journal portions 14, 15, and forming the spiral blade 11*b* on the auger body 11 in a cutting process. The manufacturing steps were carried out in a conventional manner, except for the step of plasma-transfer-arc welding.

In the plasma-transfer-arc welding process, an apparatus for preheating the base metal formed with the annular recesses and an apparatus for plasma-transfer-arc welding were used. The preheating apparatus was provided with a preheating furnace for storing a plurality of base metals. During the preheating process, the base metals was taken out one by one from the furnace after preheated for a predetermined time, and another base metal was brought into the furnace to be preheated therein.

The internal temperature of the preheating furnace was maintained at about 355° C. to preheat the base metal at a temperature of 315° C.–340° C. As a period of time required for the plasma-transfer-arc welding becomes different in accordance with the diameter and length of the shaft portions 12, 13, the preheating time of the base metal becomes different in accordance with the period of welding time. During the manufacturing process, four pieces of the base metal were stored in the preheating furnace in sequence. In the case that the base metal of the auger body 11 was 45 mm in diameter and that the base metal of the shaft portions was 16.2 mm in diameter, it took about six and half minutes for the plasma-transfer-arc welding. For this reason, the base metal was preheated in the furnace for about twenty six minutes. In the case that the base metal of the auger body 11 was 70 mm in diameter and that the base metal of the shaft portions 12, 13 was 30.4 mm in diameter, it took about nine minutes and forty seconds for the plasma-transfer-arc welding. Thus, the base metal was preheated in the furnace for thirty eight and half minutes. In the welding apparatus, the alloy containing, as main components, Co, Cr, Mo and Ni was built up in the annular recesses of the base metal by plasma-transfer-arc welding in the same manner as in a conventional manner. The welding temperature was about 1700° C.–1800° C.

During the welding process, the precipitation hardening of the base metal of auger 10 was effected by aging heat treatment caused by the preheating and the welding heat. The Vickers hardness of the base metal was 443.1 Hv in average at the respective portions. This hardness of the base metal was about 2.2 times the hardness 200 Hv before precipitation hardening. In addition, the fatigue strength of the base metal was enhanced about two times that before precipitation hardening.

In the case that precipitation hardening stainless steel (SUS 631) containing, as main components, 17Cr, 7NI and 1Al was used as a base metal of the auger body 11 without being subjected to aging heat treatment and that the anti-abrasive and anti-corrosive alloy was built up in annular recesses formed on the shaft portions 12 and 13 by plasma-transfer-arc welding in the same manner as described above, the average hardness and fatigue strength of the base metal were enhanced as in the base metal described above.

To confirm the effect of the aging heat treatment caused by the preheating and the welding heat during the plasma-transfer-arc welding process, a base metal of the precipitation hardening stainless steel (SUS 630) was subjected to aging heat treatment at 480° C. for one hour after being subjected to solid-solution heat treatment in a conventional manner. The Vickers hardness of the base metal was 423.4 HV in average at the respective portions. This means that the effect of the aging heat treatment completed during the plasma-transfer-arc welding process is substantially the same as that of the aging heat treatment in the conventional manufacturing process.

What is claimed is:

1. A method for manufacturing an auger composed of an auger body integrally formed with a spiral blade and at its opposite ends with a pair of shaft portions, said method comprising the steps of:

forming annular recesses on the shaft portions in a cutting process, building up an anti-abrasive and anti-corrosive alloy by plasma-arc welding in the annular recesses of the shaft portions and finishing each built-up portion of the alloy in a grinding process to form a journal portion on the respective shaft portions of the auger, wherein precipitation hardening stainless steel used as a base metal of the auger body is preheated for a predetermined time in a separate step prior to the plasma-arc welding of the alloy thereby subjecting the body to aging heat treatment caused by the combination of preheating and welding heat during the plasma-arc welding process.

2. The manufacturing method of claim 1, wherein the precipitation hardening stainless steel used as the base metal essentially consists of 17Cr, 4Ni and 4Cu.

3. The manufacturing method of claim 1, wherein the precipitation hardening stainless steel used as the base metal essentially consists of 17Cr, 7Ni and 1Al.

4. The manufacturing method of claim 1, wherein the precipitation hardening stainless steel is preheated at a temperature of 300° C.–350° C. for twenty minutes to eighty minutes.

5. The manufacturing method of claim 1, wherein the anti-abrasive and anti-corrosive alloy contains, as main components, Co, Cr, Mo and Ni.

6. A method for manufacturing an auger composed of an auger body integrally formed thereon with a spiral blade and at its opposite ends with a pair of shaft portions, said method comprising the steps of:

forming annular recesses on the shaft portions in a cutting process;

building up an anti-abrasive and anti-corrosive alloy by plasma-arc welding in the annular recesses of the shaft portions; and finishing each built-up portion of the alloy in a grinding process to form a journal portion on the respective shaft portions of the auger;

wherein precipitation hardening stainless steel subjected to solid-solution heat treatment is used as a base metal of the auger body without being subjected to aging heat treatment for precipitation hardening and is preheated for a predetermined time prior to the step of plasma-arc welding of the alloy and thereby effectively subjected to aging heat treatment caused by the combination of preheating and welding heat during the plasma-arc welding process.

* * * * *